US009199262B2

(12) United States Patent
Bartelick

(10) Patent No.: US 9,199,262 B2
(45) Date of Patent: Dec. 1, 2015

(54) RETRACTABLE SPRAY HOSE WITH AUTOMATIC SHUTOFF

(71) Applicant: Alto-Shaam, Inc., Menomonee Falls, WI (US)

(72) Inventor: Janus Bartelick, Germantown, WI (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 215 days.

(21) Appl. No.: 13/897,984

(22) Filed: May 20, 2013

(65) Prior Publication Data

US 2014/0339332 A1 Nov. 20, 2014

(51) Int. Cl.

| | |
|---|---|
| ***B05B 15/06*** | (2006.01) |
| ***B05B 1/30*** | (2006.01) |
| ***B05B 12/00*** | (2006.01) |
| ***A21B 3/00*** | (2006.01) |
| *B05B 1/18* | (2006.01) |

(52) U.S. Cl.

CPC ..... *B05B 15/061* (2013.01); *A21B 3/006* (2013.01); *B05B 1/30* (2013.01); *B05B 12/002* (2013.01); *B05B 15/06* (2013.01); *B05B 1/18* (2013.01)

(58) Field of Classification Search

CPC . F16L 3/012; B65H 75/4471; B65H 75/4434; B05B 15/061; B05B 9/04; B05B 12/002; B05B 1/30

USPC ..... 242/385, 385.1, 385.3, 396.2; 239/195, 239/196, 197, 198, 525; 137/355.19, 137/355.12; 251/218, 352, 83; 126/276

See application file for complete search history.

(56) References Cited

U.S. PATENT DOCUMENTS

| | | | | |
|---|---|---|---|---|
| 1,147,327 | A * | 7/1915 | Kinch | 137/355.19 |
| 6,188,045 | B1 | 2/2001 | Hansen et al. | |
| 6,416,009 | B1 * | 7/2002 | Iaciofano et al. | 242/384.7 |
| 6,608,288 | B2 | 8/2003 | Maahs | |
| 6,883,537 | B1 * | 4/2005 | Lin | 137/355.16 |
| 7,150,425 | B2 * | 12/2006 | Banaszkiewicz et al. | 242/385.3 |
| 7,307,244 | B2 | 12/2007 | Hansen et al. | |
| 7,947,943 | B2 * | 5/2011 | Jaskol et al. | 250/215 |
| 7,949,943 | B2 * | 5/2011 | Michaud et al. | 715/234 |
| 8,267,330 | B2 * | 9/2012 | Huang | 239/198 |
| 8,356,567 | B1 * | 1/2013 | Gaston et al. | 114/242 |
| 2005/0156060 | A1 * | 7/2005 | Attar | 239/332 |
| 2008/0223357 | A1 * | 9/2008 | Bartelick et al. | 126/21 A |

* cited by examiner

*Primary Examiner* — Arthur O Hall
*Assistant Examiner* — Joseph A Greenlund
(74) *Attorney, Agent, or Firm* — Boyle Fredrickson, S.C.

(57) ABSTRACT

A spray hose and spray nozzle for a commercial oven may be retracted on a spring-loaded reel. A position and recent movement of the spring-loaded reel may be used to deduce likely intent of the user with respect to use of the spray nozzle and to electronically activate or deactivate water flow to the spray hose based on the deduced intent.

16 Claims, 4 Drawing Sheets

RETRACTABLE SPRAY HOSE WITH AUTOMATIC SHUTOFF

BACKGROUND OF THE INVENTION

The present invention relates to a retractable spray hose for an oven or the like and in particular to a spray hose that reduces the chance of accidental discharge during extension and retraction.

Commercial ovens are frequently provided with spray hoses, for example, attached to a reel that allow the interior of the oven to be readily cleaned. Such cleaning helps to reduce buildup of grease or other deposits on the walls of the oven such as may lead to the transfer of cooking flavors between foods or which may burn producing unwanted smoke or burning odors.

The spray hose may provide a shower type head that may include a built-in water valve allowing the user to easily control the spray of the water. In order to prevent damage to the hose when it is not in use and conserve space within the kitchen, the hose may be stored on a spring-loaded reel, for example, attached to the bottom of the housing of the oven. In order to use the hose, the user may grasp the spray nozzle as positioned in a cradle near an opening in the reel and by pulling the spray nozzle out, pull the hose through that opening to a proper length for cleaning. A locking mechanism such as a ratchet may lock the reel against retraction during the cleaning operation and then be released to allow the hose to be fully retracted after use.

It is desirable to have a positive shutoff of the water through the hose other than that provided by the shower nozzle. To this purpose an additional shutoff valve may be exposed for control by the user to allow the water to be disconnected from the hose.

SUMMARY OF THE INVENTION

The present invention provides an automatic shutoff for a spray hose, where the shutoff is activated by movement of the retraction reel. The automatic shutoff substantially reduces the chance that the spray nozzle will be accidentally activated when it is grasped to extend the hose and can prevent water spray or leakage in certain failure conditions, important when the reel is mounted in the oven housing. By sensing reel movement to activate the shutoff, a generous shutoff state may be defined for reel positions near full retraction, eliminating the need for a full retraction and seating of the spray nozzle (for example in a cradle) such as may be necessary to activate a cradle switch or the like. Sensing of reel position eliminates the need for special sensor elements incorporated into the hose or spray nozzle that might make replacement of these parts difficult. Sensing of reel position allows for complete shutoff even if the spray head were to become dislodged or damaged.

In one embodiment, the invention may be an oven with a housing providing an oven cavity accessible through a door which may be opened and closed about the cavity, the oven cavity having a heater for heating the cavity for cooking food. A spring biased hose reel is attached to the housing allowing extension of a hose from the hose reel with rotation of the hose reel to unwind the hose in a first direction against a spring biasing and allowing retraction of the hose with rotation winding of the hose about the hose reel in a second opposite direction with the spring biasing. An electronic water valve may receive water from a source of pressurized water and communicate it to the hose on the hose reel when the electronic water valve is opened with a valve open signal. A hose reel sensor senses a first state of the hose reel when the hose is fully retracted and a second state of the hose reel when the hose is fully extended to provide the valve open signal in the second state and not the first state.

It is thus a feature of at least one embodiment of the invention to provide an automatic shutoff of the water to a spray nozzle that does not require special sensing or precise seating of the spray nozzle in a holder or the like.

The hose reel sensor may be sensitive to movement of the hose reel position.

It is thus a feature of at least one embodiment of the invention to provide a simple method of deriving the position of the hose without the need to directly sense a flexible or movable component such as the hose or spray nozzle.

The hose reel sensor may detect the first state, in part, based on hose reel position.

It is thus a feature of at least one embodiment of the invention to provide a system that is sensitive, at least in part, to absolute reel position such as provides an imputed intent of the user indicating whether the sprayer should be activated.

The hose reel sensor may, in addition or alternatively, detect the first state in part based on a last direction of hose reel movement.

It is thus a feature of at least one embodiment of the invention to allow it to look beyond simple hose position and to shut off the sprayer hose, for example, as it is being retracted even though its absolute position is momentarily in a fully extended position.

The hose reel may include a ratchet system for locking the hose reel against retraction with the spring biasing and the hose reel sensor may be sensitive to a locking of the hose reel. The hose reel sensor may detect the second state, in part based, on a locking of the hose reel position with the ratchet system. The second state may occur only when the reel is in a position to lock.

It is thus a feature of at least one embodiment of the invention to make use of a pre-existing ratchet mechanism to readily deduce the intent of the user, using an assumption that the hose reel will be locked for use of the sprayer.

The ratchet may include a ratchet pawl and the hose reel sensor may sense the position of the ratchet pawl.

It is thus a feature of at least one embodiment of the invention to make use of the existing ratchet pawl to readily distinguish among multiple states of the hose reel based on multiple states of the ratchet mechanism.

The hose reel sensor may include a magnet on the ratchet pawl and a magnetic sensor.

It is thus a feature of at least one embodiment of the invention to provide a simple way of deducing hose reel state that may be extracted with an environmentally robust magnetic sensing system.

The hose may terminate in a spray nozzle having a user-operated valve.

It is thus a feature of at least one embodiment of the invention to provide a system that reduces the possibility of accidentally activating the sprayer when extending the hose by grasping the spray nozzle.

These particular objects and advantages may apply to only some embodiments falling within the claims and thus do not define the scope of the invention.

DETAILED DESCRIPTION OF THE PREFERRED EMBODIMENT

Figure 1:
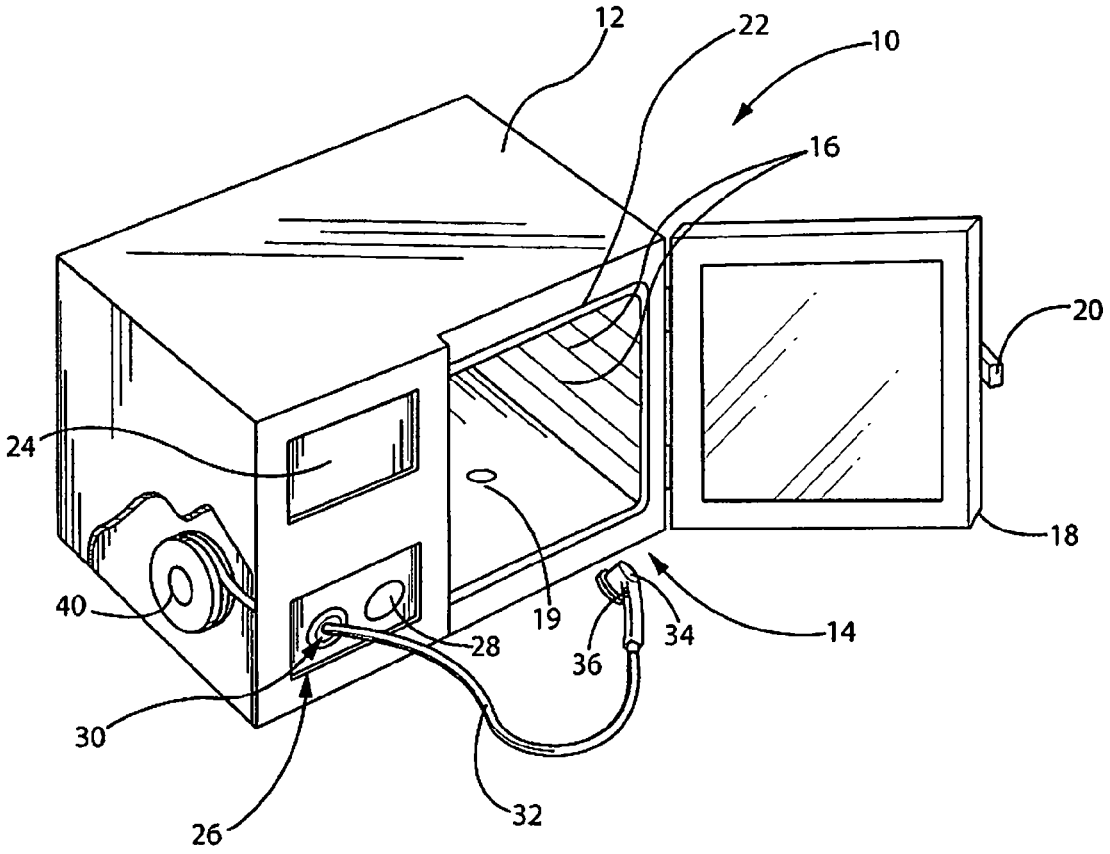
FIG. 1 is a simplified perspective view of an oven having an extendable spray hose, and a housing of the oven in partial cutaway showing an internal hose retractor.

Referring now to FIG. 1, an oven 10, according to one embodiment of the present invention, may provide a housing 12 defining an internal oven cavity 14. Sidewalls of the oven cavity 14 may provide for rack supports 16 holding conventional cooking racks for supporting pans or trays of food. A bottom wall cooking volume may provide for a drain 19 that may receive wastewater during the cleaning process.

The oven cavity 14 may be accessed through a door 18 connected by a hinge at one vertical side of the oven cavity 14. The door 18 may close over the oven cavity 14 during the cooking operation as held by a latch assembly 20 (visible on the door 18 only). In the closed position, the door 18 may substantially seal against the oven cavity 14 by compressing a gasket 22 surrounding an opening of the oven cavity 14 in the housing 12.

At one side of the oven cavity 14, the housing 12 may support a control panel 24 accessible by a user standing at a front of the oven 10. The control panel 24 may provide conventional electronic controls such as switches, buttons, a touchscreen or the like that may receive oven control data from the user as will be described below.

Ovens of this type may include steam generators, convection fans, smokers and the like and are commercially available from the Alto-Shaam Inc. of Menomonee Falls, Wis. and are described generally in U.S. Pat. Nos. 6,188,045, 6,608,288 and 7,307,244 all assigned to the assignee of the present invention and incorporated by reference Positioned beneath the control panel may be a sprayer access panel 26 providing an operator for a sprayer water shutoff valve 28 and an opening 30 through which a sprayer hose 32 may extend. A sprayer nozzle 34 may be attached to the end of the sprayer hose 32 to direct water supplied by the sprayer hose 32 into a dispersed high-pressure spray for cleaning of the oven cavity 14. The sprayer nozzle 34 may include a hand operated nozzle valve 36 that also provides for means of controlling the water flow through the hose 32 together with the manual shutoff valve 28.

The sprayer hose 32 extends from the sprayer nozzle 34 into the housing 12 through the opening 30 to be received by a hose retractor 40 that may serve to receive and coil the hose 32 after use.

Figure 2:
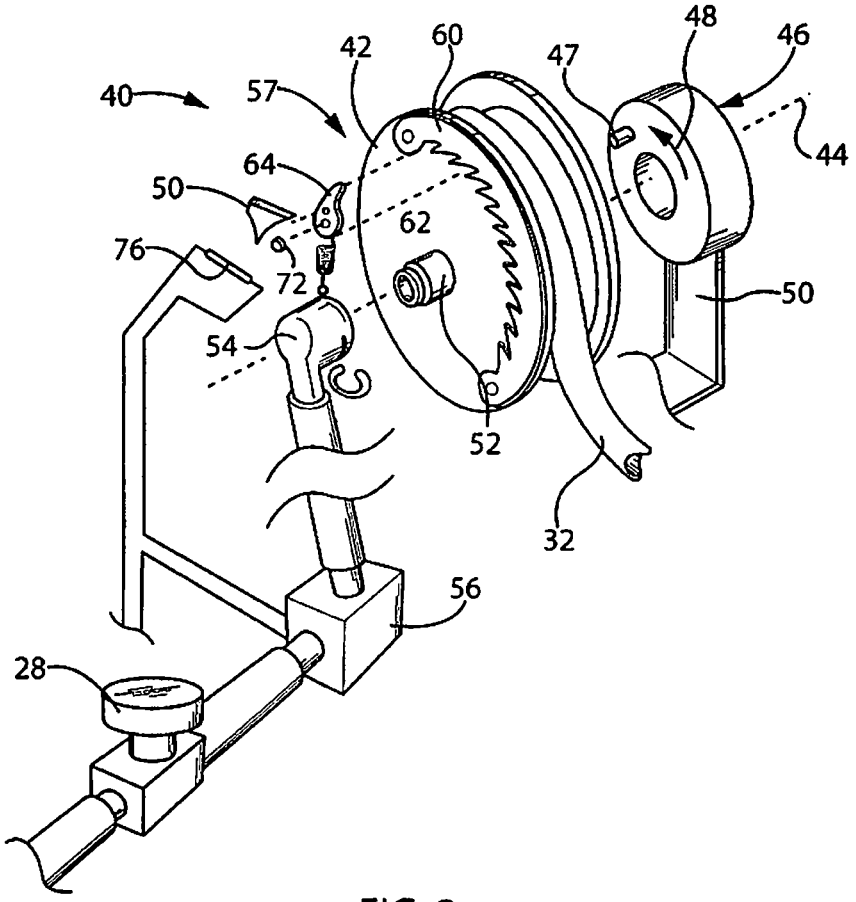
FIG. 2 is an exploded diagram of the hose retractor of FIG. 1 showing a constant force spring biasing a hose reel, the latter having a ratchet mechanism for locking the hose reel in extension and further showing a rotational water coupling and sensor system of the present invention.

Referring now also to FIG. 2, the hose retractor 40 may provide for a hose reel 42, generally providing two disc-shaped rims around a smaller radius cylindrical hub (not visible) about which the hose 32 may be fully wound in a retracted state. The hose reel 42 may rotate about an axis 44 and is biased in a retracting direction 48 (as indicated by the arrow in FIG. 2) by the force of a constant force spring 46 attached to the hose reel 42. The retracting direction 48 serves to wind the hose 32 around the hose reel 42.

The constant force spring 46 communicates with the hose reel 42 by a key 47 and with the housing 12 by means of a bracket 50 attached to the housing 12. The constant force spring 46 may also support a support shaft (not shown) on which the hose reel 42 rotates. On an opposite side of the hose reel 42 from the constant force spring 46, axial support of the hose reel 42 may be provided by a rotatable pipe coupling 52 extending along the axis 44 and receivable by a collar 54 to form with the collar 54 a watertight conduit through which water may flow but which nevertheless permits free rotation of the hose reel 42 about the axis 44. The coupling 52 enters the hose reel 42 where it is attached with one end of the hose 32 so that water delivered from the collar 54 passes through the coupling 52 and into the hose 32 to supply water to the hose 32 and the spray nozzle 34.

The coupling 52 may receive water from an electric water valve 56 which in turn communicates with the valve 28, the latter of which is attached to a source of pressurized water such as a water main or the like.

Generally as a hose 32 is withdrawn from the reel 42, the reel 42 rotates counter to the retracting direction 48 urged by the constant force spring 46 (clockwise as shown in FIG. 2) allowing the hose 32 to be extracted. When use of the hose 32 is complete, the constant force spring 46 urges the hose reel 42 in the counterclockwise direction (as viewed in FIG. 2) to wind the hose 32 about the hose reel 42 until the spray nozzle 34 is pulled against the opening 30 for retention there.

Referring now to FIGS. 2 and 3, rotation of the hose reel 42 may be constrained by a ratchet assembly 57 comprising an arcuate rack 60 following a radius of an outer periphery of one rim of the hose reel 42 approximately halfway around the circumference of the reel 42. The rack 60 may have inwardly extending rack teeth 62 canted back along an axis spiraling counterclockwise (as shown) as one moves toward a center of the hose reel 42.

A pawl 64 may engage the teeth 62 to prevent counterclockwise rotation of the hose reel 42 when the pawl 64 is engaged with the teeth 62 and to allow clockwise rotation despite any such engagement. The pawl 64 may be mounted to pivot about a pivot point 66 fixed with respect to a portion of a support bracket 50 as is attached to the housing 12.

Figure 3C:
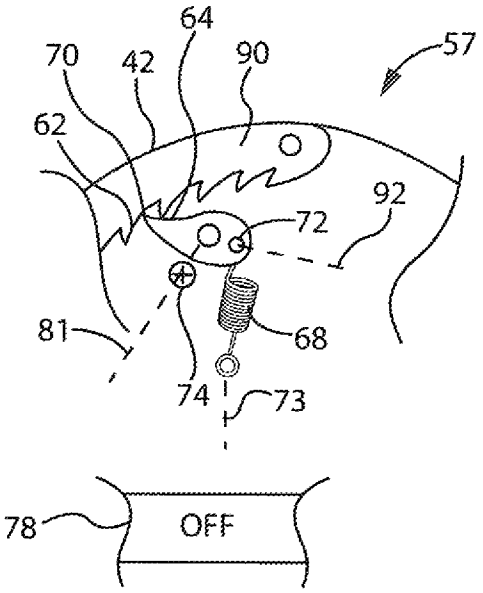
FIGS. 3*a-c* are fragmentary side views of the ratchet mechanism of FIG. 2 at different positions of the hose reel showing a sensed state for each position.
Figure 3B:
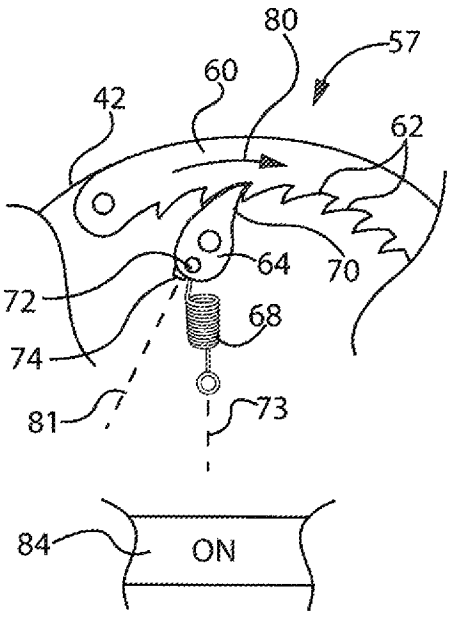
Figure 3A:
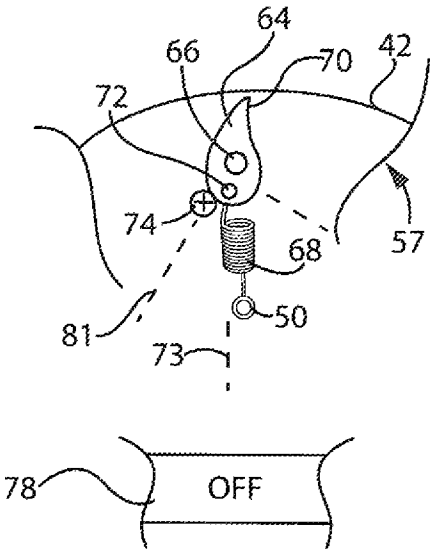

Referring now to FIGS. 2 and 3*a*, the pawl 64 when unengaged with the teeth 62 of the rack 60 assumes a neutral position 73 under a biasing of the spring 68 attached between the pawl 64 and the bracket 50. In this unengaged position, a pawl finger 70 of the pawl 64 such as may engage the teeth 62 is directed generally radially outward toward the rim of the hose reel 42.

A portion of the pawl 64 between the pivot point 66 and an attachment of the springs 68 may include a magnet 72. In this neutral position 73, the magnet 72 is displaced away from a sensing location 74 where the magnet 72 may be sensed by a magnetic sensor 76 generally fixed with respect to the housing 12.

The magnetic sensor 76 may, for example, be a reed relay (as shown) or Hall effect device and is wired in series with electrical power provided to the valve 56 so that the valve 56 opens or operates only when the magnet 72 is in the sensing location 74 as sensed by the magnetic sensor 76. The magnetic sensor 76 may be shielded from the reel 42 by the support bracket 50 which may, for example, be a non-ferromagnetic material such as stainless steel. In this neutral position 73, a state of the hose reel 42 is identified to an "off" state 78 where water flow to the hose 32 is prevented by the valve 56.

Referring now to FIG. 3*b*, after the spray hose 32 has been extended from the housing 12 with clockwise rotation 80 of the reel 42, the pawl 64 may engage the teeth 62 of the rack 60 and move to an active position 81 where the magnet 72 overlies the sensing location 74. In this active position 81, the state of the hose reel 42 is identified to an "on" state 84 where water flow to the hose 32 is allowed by valve 56. In this active position 81, if the hose 32 were to be released, the pawl 64 would prevent rewinding of the spray hose 32 on the hose reel 42 by engagement of the pawl finger 70 with the teeth 62 of the rack 60. In this state, the hose reel 42 is termed "locked" meaning that retraction of the hose 32 is prevented such as suggests the user is ready to use the spray nozzle 34 (shown in FIG. 1).

Referring now to FIG. 3*c*, the hose reel 42 may be unlocked by continuing to draw the hose 32 from the hose reel 42 with a clockwise rotation 80 until the rack 60 passes completely by the pawl 64 and the pawl 64 returns to a neutral position 73 shown in FIG. 3*a*. Upon release of the spray hose 32 and counterclockwise movement 90 of the hose reel 42, the pawl 64 is pushed backward against the biasing of spring 68 to a third inactive position 92 with the magnet 72 removed from the sensing location 74 producing an off state 78 as described above. In this position, a release of the spray hose 32 will cause its further retraction into the housing 12 wrapped around the hose reel 42 because the pawl 64 is out of position to engage in the retracting teeth 62. This unlocked state suggests that the hose 32 is being returned after use and spraying of the nozzle 34 is not desired thus justifying the off state 78.

Figure 4:
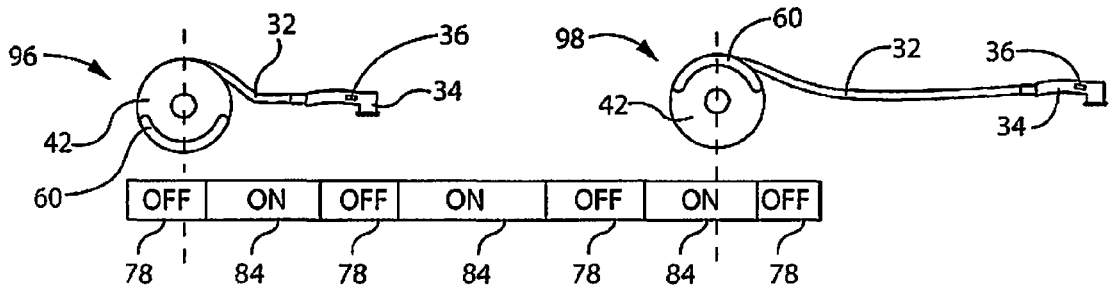
FIG. 4 is a diagram showing extension of the hose and a transition between multiple reel states associated with water being switched on and off, further showing alignment of an off state with the hose fully retracted and on state with the hose fully extended and locked.

Referring now to FIG. 4, typically multiple rotations of the reel 42 may be required to move the spray nozzle 34 from a fully retracted position 96 to a fully extended position 98. During that retraction process the detected state of the hose reel 42 will move between "off" state 78 and "on" state 84 several times. Nevertheless, the size of the hose reel 42 and the full extension position of the spray nozzle 34 determined by the length of the hose 32 may be set such that when the spray hose 32 is in the fully retracted position 96, the state of the reel 42 is comfortably within the off state 78 whereas when the hose 32 is substantially fully extended (except for a minor extension required to initiate the retraction process) the detected state of the hose reel 42 is comfortably in "on" state 84.

It will be understood generally that the system described above can be said to detect the position of the hose reel 42 (by virtue of the partial coverage of the reel 42 with rack 60) as well as to detect recent reel movement (based on the state of the pawl being in either active position 81 or inactive position 92) and thus that considerable information may be derived from this sensing related to probable intentions of the user.

By shutting off the spray hose 32 when it is fully retracted, occurrences of accidentally grabbing the spray nozzle 34 and activating the nozzle valve 36 are greatly reduced. Further, water spray during an accident such as detachment of the spray nozzle 34 from the spray hose 32 may be limited by a resulting rapid recoiling of the hose 32 to an over-retracted position associated with the off state 78. This over-retracted position may correspond with the full unwinding of the constant force spring 46 set to align with an off state 78 (perhaps with an additional full rotation after the normal full retraction of the hose 32).

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What I claim is:

1. An oven comprising:

an outer oven housing providing an internal cooking cavity accessible through a door which may be opened and closed about the cavity, the cooking cavity including a heater for heating the cavity cooking food wherein the oven housing has an outer surface accessible to a user from outside the oven housing and an inner volume removed from the cooking cavity and inaccessible to the user from outside the oven housing;

a spring biased hose reel held within the inner volume of the oven housing allowing extension of a hose from the hose reel with rotation of the hose reel to unwind the hose in a first direction against a spring biasing and allowing retraction of the hose with rotation winding of the hose about the hose reel in a second opposite direction with the spring biasing;

an electronic water valve receiving water from a source of pressurized water and communicating it to the hose on the hose reel when the electronic water valve is opened with a valve open signal;

a hose reel sensor sensing a first state of the hose reel when the hose is fully retracted and a second state of the hose reel when the hose is fully extended to provide the valve open signal in the second state and not the first state; and a manually operated nozzle valve communicating the flow of water through a spray nozzle of the hose when the manually operated nozzle valve is opened;

wherein the outer surface of the housing includes an opening and the hose extends from the reel through the opening to the manually operated nozzle valve.

2. The oven of claim 1 wherein the hose reel sensor is sensitive to movement of the hose reel position.

3. The oven of claim 2 wherein the hose reel sensor detects the first state in part based on hose reel position.

4. The oven of claim 2 wherein the hose reel sensor detects the first state in part based on a last direction of hose reel movement.

5. The oven of claim 1 wherein the hose reel includes a ratchet system for locking the hose reel against retraction with the spring biasing and wherein the hose reel sensor is sensitive to a locking of the hose reel.

6. The oven of claim 5 wherein the hose reel sensor detects the second state in part based on a locking of the hose reel position with the ratchet system.

7. The oven, of claim 6 wherein the second state occurs only when the reel is in a position to lock.

8. The oven of claim 5 wherein the ratchet system includes a ratchet pawl and the hose reel sensor senses the position of the ratchet pawl.

9. The oven of claim 5 wherein the ratchet includes an arcuate ratchet element positioned along a path of constant radius about a rotational axis of the reel for less than a full angular extent of the reel.

10. The oven of claim 8 wherein the hose reel sensor comprises a magnet on the ratchet pawl.

11. The oven of claim 1 wherein the hose reel sensor is magnetic sensor.

12. The oven of claim 11 wherein the hose reel sensor includes a reed relay.

13. The oven of claim 1 wherein the spring is a constant force spring.

14. The oven of claim 1 wherein the valve communicates with the hose reel through a rotating connector to which the hose is attached.

15. The oven of claim 1 wherein the hose terminates in a spray nozzle having a user-operated valve.

16. The oven of claim 15 wherein when the hose is fully retracted the spray nozzle is pulled part way into the opening in the oven housing to be pulled on to extend the spray nozzle.

* * * * *